US011027812B2

(12) United States Patent
Lindeborg

(10) Patent No.: US 11,027,812 B2
(45) Date of Patent: Jun. 8, 2021

(54) METHOD FOR A PROPULSION ARRANGEMENT FOR A MARINE VESSEL

(71) Applicant: CPAC SYSTEMS AB, Gothenburg (SE)

(72) Inventor: Mathias Lindeborg, Gothenburg (SE)

(73) Assignee: CPAC SYSTEMS AB, Gothenburg (SE)

( * ) Notice: Subject to any disclaimer, the term of this patent is extended or adjusted under 35 U.S.C. 154(b) by 221 days.

(21) Appl. No.: 16/315,716

(22) PCT Filed: Jul. 7, 2016

(86) PCT No.: PCT/EP2016/066122
§ 371 (c)(1),
(2) Date: Jan. 7, 2019

(87) PCT Pub. No.: WO2018/006962
PCT Pub. Date: Jan. 11, 2018

(65) Prior Publication Data

US 2019/0210705 A1 Jul. 11, 2019

(51) Int. Cl.
*B63H 21/21* (2006.01)
*F02D 3/00* (2006.01)

(52) U.S. Cl.
CPC ..... *B63H 21/21* (2013.01); *B63H 2021/216* (2013.01); *F02D 3/00* (2013.01); *F02D 2200/501* (2013.01)

(58) Field of Classification Search
CPC ..... B63H 21/21; B63H 2021/216; F02D 3/00; F02D 2200/501
See application file for complete search history.

(56) References Cited

U.S. PATENT DOCUMENTS 6,587,765 B1 * 7/2003 Graham ..... B63H 21/21 440/84
8,454,402 B1 * 6/2013 Arbuckle ..... B63H 21/21 440/86

(Continued)

FOREIGN PATENT DOCUMENTS

CN 101228065 A 7/2008
CN 101520467 A 9/2009

(Continued)

OTHER PUBLICATIONS

China Office Action dated Aug. 31, 2020 in corresponding China Application No. 201680087204.0, 8 pages.

(Continued)

*Primary Examiner* — Richard M Camby
(74) *Attorney, Agent, or Firm* — Venable LLP; Jeffri A. Kaminski

(57) ABSTRACT

A method for a propulsion arrangement (101) for providing propulsive power to a marine vessel (1), the method comprising the steps of: —determining (S1) whether the vessel (1) is running by means of the propulsion arrangement at a constant vessel speed, —storing (S3) a value (V1) of the constant vessel speed, —detecting (S4) a value (n1) of a rotational speed of a rotatable part (102) of the propulsion arrangement while the vessel is running at the constant vessel speed, —storing (S5) the detected rotational speed value, —subsequently controlling (S6) the propulsion arrangement so as to change the vessel speed, —subsequently repeating (S7-S11) the steps of determining whether the vessel is running at a constant vessel speed, storing a value (V2-V4) of the constant vessel speed, and detecting and storing a value (n2-n4) of the rotational speed of the rotatable part, to obtain a plurality of stored pairs of vessel speed values and rotational speed values, and —creating (Continued)

(S12) based at least partly on the stored pairs of values a correlation record (126) correlating vessel speed values with rotational speed values.

14 Claims, 5 Drawing Sheets

(56) References Cited

U.S. PATENT DOCUMENTS

| | | | | |
|---|---|---|---|---|
| 9,233,744 | B2 | 1/2016 | Clever et al. | |
| 9,441,724 | B1 * | 9/2016 | Pugh | F16H 57/01 |
| 10,048,690 | B1 * | 8/2018 | Hilbert | B63H 21/21 |
| 10,167,798 | B1 * | 1/2019 | Van Camp | G06F 3/04883 |
| 10,766,592 | B1 * | 9/2020 | Przybyl | F02D 25/02 |
| 2012/0191277 | A1 * | 7/2012 | Clever | B63H 21/22 701/21 |
| 2016/0280351 | A1 * | 9/2016 | Ito | B63B 34/60 |

FOREIGN PATENT DOCUMENTS

| | | | |
|---|---|---|---|
| CN | 101808893 | A | 8/2010 |
| CN | 102914664 | A | 2/2013 |
| CN | 102959216 | A | 3/2013 |
| JP | 2011127671 | A | 6/2011 |
| JP | 2014240250 | A | 12/2014 |
| WO | 2011/122375 | A1 | 10/2011 |
| WO | 2011/125466 | A1 | 10/2011 |

OTHER PUBLICATIONS

European Communication pursuant to Article 94(3) EPC dated Sep. 1, 2020 in corresponding European Application No. 16738714.1, 7 pages.

* cited by examiner

METHOD FOR A PROPULSION ARRANGEMENT FOR A MARINE VESSEL

TECHNICAL FIELD

The invention relates to a method for a propulsion arrangement for providing propulsive power to a marine vessel. The invention also relates to a computer program, a computer readable medium, a control unit, a propulsion arrangement, and a marine vessel.

The invention is not restricted to any particular type of marine vessel. Instead it may be used on any type and any size of marine vessel, water surface vessels as well as submarines.

BACKGROUND

In marine vessel transitional speed control there are often problems related to sensor data used to the control. When a transducer with speed-through-water is used the data is often unreliable, and when a Global Positioning System (GPS) device is used the provided speed-over-ground data may have a delay that makes it difficult to use in vessel transitional speed control, e.g. during vessel acceleration. These problems may result in an undesired behavior of the vessel, such as a target vessel speed being overshot or undershot during a transitional phase.

US2012191277 discloses storing an acceleration profile specifying a manner of accelerating a marine vessel. In response to a command from a vessel operator, the acceleration profile is retrieved and a desired engine speed is adjusted based on the acceleration profile. The engine speed of the marine vessel is controlled based on the desired engine speed.

However, an acceleration profile as suggested in US2012191277 provides a predetermined vessel speed to time correlation, which is unpractical for many vessel types or operational situations. There is therefore a desire to provide a marine vessel speed control which is accurate, as well as flexible and useful in a variety of operational situations, and in a variety of vessels and vessel types.

SUMMARY

An object of the invention is to improve the speed control of marine vessels. It is also an object of the invention to provide a marine vessel speed control which is accurate, as well as flexible and useful in a variety of operational situations, and in a variety of vessels and vessel types.

The objects are reached with a method according to claim 1. Thus, the invention provides a method for a propulsion arrangement for providing propulsive power to a marine vessel, characterized by

- determining whether the vessel is running by means of the propulsion arrangement at a constant vessel speed,
- storing a value of the constant vessel speed,
- detecting a value of a rotational speed of a rotatable part of the propulsion arrangement while the vessel is running at the constant vessel speed,
- storing the detected rotational speed value,
- subsequently controlling the propulsion arrangement so as to change the vessel speed,
- subsequently repeating the steps of determining whether the vessel is running at a constant vessel speed, storing a value of the constant vessel speed, and detecting and storing a value of the rotational speed of the rotatable part, to obtain a plurality of stored pairs of vessel speed values and rotational speed values, and
- creating based at least partly on the stored pairs of values a correlation record correlating vessel speed values with rotational speed values.

The constant vessel speed may be indicative of a stable condition of the vessel, suitable for the speed value detection and storage for the correlation record. A constant speed will occur regularly during normal use of a vessel, and with the invention these "opportunities may be taken" to gather data for the correlation record. It should be noted that any pair of a vessel speed value and a rotational speed value may be gathered automatically, e.g. by a control unit as exemplified below, or upon a manual manipulation of a suitable operational interface to trigger the detection and storage of the values in the pair. It is understood that the constant speed may occur during a certain time interval, and that the vessel speed detection and the rotational speed detection are preferably made within that time interval.

The correlation record may be used to improve the control of the vessel. As exemplified below, vessel speed control may be considerably more accurate with the correlation record. In addition, the invention provides for creating the correlation record while the vessel is in normal use. For example, the detection and storage of the speed values is advantageously done during the lifetime of the vessel, i.e. during normal operation of operation of the vessel, e.g. for transport, leisure, waterskiing, etc.

Thereby the detection and storage of the speed values, and the correlation record allows adaption of the vessel control to individual characteristics in the behaviour of the particular vessel. Such individual characteristics may be different from one vessel to another, even if they are of the same make, model and year, e.g. due to their respective operational history, or the degree of external fouling of the hull, etc. It should be noted that different degrees of external hull fouling may provide considerable differences between the vessel speed to engine speed correlations in different vessels. Thus, in the hands of a vessel user, the invention may provide for an exact vessel speed control while making it possible to avoid errors due to different characteristics of separate individual vessels.

It is understood that the marine vessel could be of any size and type, e.g. a water surface vessel or even a submarine. The vessel speed values may be detected using any suitable vessel speed detecting device which may be provided on the vessel, such a transducer for speed-through-water detection, e.g. in the form of a paddle sensor, or a device determining the speed by means of the Global Positioning System (GPS).

Detecting the value of the rotational speed of the rotatable part of the propulsion arrangement may be done by means of a suitable rotational speed detecting device, such as an engine rpm sensor, e.g. in the form of a crankshaft position sensor, or a sensor arranged to detect the speed of some other rotatable part of the propulsion arrangement, e.g. a propeller driveshaft.

Preferably, the step of creating a correlation record comprises interpolating the stored pairs of values. As, during use of the vessel, the number of pairs of speed values in the correlation record may increase, so will the accuracy of the correlation record, enabling a gradually increasingly refined control of the vessel. However, the interpolation will enable the correlation record to be used although vessel control set points may occur between value pairs in the correlation record.

The method according to embodiments of the invention may comprise stopping the propulsion arrangement after creating the correlation record, subsequently starting the propulsion arrangement, subsequently repeating the steps of determining whether the vessel is running at a constant vessel speed, storing a value of the constant vessel speed, and detecting and storing a value of the rotational speed of the rotatable part, and adjusting the correlation record based at least partly on the vessel speed and rotational speed values detected after the step of starting the propulsion arrangement. Thus, as also suggested above, the detection and storage of further speed value pairs may continue through the lifetime of the vessel, with intermediate vessel stoppage periods occurring during its normal use.

In some embodiments, adjusting the correlation register may comprise deleting from the correlation register at least one pair of a vessel speed value and a rotational speed value, the storage of which is above a predetermined age. This may include deleting from the correlation register one or more pairs of vessel speed and rotational speed values, the storage of which are older than the storage of other pairs of vessel speed and rotational speed values in the correlation register. Thereby, old value entries may be removed since they might have become inaccurate, e.g. due to normal changes in the vessel behaviour due its operational history, or due to external fouling of the hull.

Preferably the method comprises determining whether the vessel is moving in a straight course while running at the constant speed, such that the plurality of stored pairs of vessel speed values and rotational speed values, based on which the correlation record is created, are detected while the vessel is moving in a straight course. Thereby, any difference in the vessel speed to rotational speed correlation based on whether the vessel in moving straight or turning is kept out of the correlation record. Determining whether the vessel is moving in a straight course may be made by any suitable means, e.g. a compass, a GPS device or a steering control sensing device such as a position sensor at a steering wheel, a sterndrive, a pod drive or a rudder of the vessel.

Embodiment of the method may advantageously comprise using the correlation record by receiving a requested value of the vessel speed, determining by means of the correlation record a rotational speed value that is correlated to the requested vessel speed value, and controlling the rotational speed so as to reach the correlated rotational speed value. Preferably, controlling the rotational speed comprises detecting a present value of the rotational speed, and adjusting a propulsion arrangement control device based at least partly on the detected present rotational speed value and the correlated rotational speed value. The requested vessel speed value may be received from a control interface arranged to be manipulated by a driver of the vessel.

Such use of the correlation record may provide for the present rotational speed value to arrive, during a speed transition, at the correlated rotational speed value along a continuous and smooth curve. In speed transitions, detected values of the rotational speed of the propulsion arrangement part are much more likely to be close to the real and current rotational speed values, compared to detected values of the vessel speed in relation to the real and current vessel speed values. This may be due to often inherent inaccuracies or delays in the use of vessel speed detecting devices such as paddle wheel sensors or GPS devices. Thus, since according to embodiments of the invention the propulsion arrangement control is based on the rotational speed rather than the vessel speed, overshooting or undershooting the requested vessel speed value may be avoided.

Again, by regularly detecting and storing speed values for the tool for this propulsion arrangement control, the correlation between vessel and rotational speed will be up to day, accurate, and adapted to the individual vessel. I.e. embodiments of the invention provides by the correlation record setup steps an adaptive learning algorithm improving the control loop for the vessel speed.

The adjustment of the propulsion arrangement control device based at least partly on the detected present rotational speed value and the correlated rotational speed value, may be executed e.g. by proportional feedback control, possibly with derivative and integral factors, i.e. PID-control. However, in alternative embodiments the speed transition may be a predetermined function of time.

The propulsion arrangement may comprise any suitable type of power generating device, e.g. an electric motor or an internal combustion engine. The propulsion arrangement control device may be provided as any suitable device, e.g. an engine air intake throttle valve, or a fuel injection control device, or a frequency controlled power electronics of an electric motor. In the case of engines, the type of propulsion arrangement control device used may depend on the type of engine used, e.g. a spark ignited or a compression ignited engine.

The control interface may be provided in any suitable form, e.g. as a digital control interface, e.g. with a touch display screen. The control interface may allow the driver to control the vessel speed in a direct manner or in some other manner, e.g. through cruise control.

In some embodiments, where the propulsion arrangement comprises more than one powertrain, the method comprises determining how many of the powertrains that are in operation, wherein the correlation record's correlation of the vessel speed values with rotational speed values depends on the number of powertrains in operation. Thereby, as exemplified below, the method is advantageously adapted to multi powertrain vessels, in which less than all powertrains may be in operation during use of the vessel.

The objects are also reached with a computer program according to claim 10, a computer readable medium according to claim 11, a control unit according to claim 12, a propulsion arrangement according to claim 13, and a marine vessel according to claim 14.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples. In the drawings.

DETAILED DESCRIPTION OF EXAMPLE EMBODIMENTS OF THE INVENTION

Figure 1:
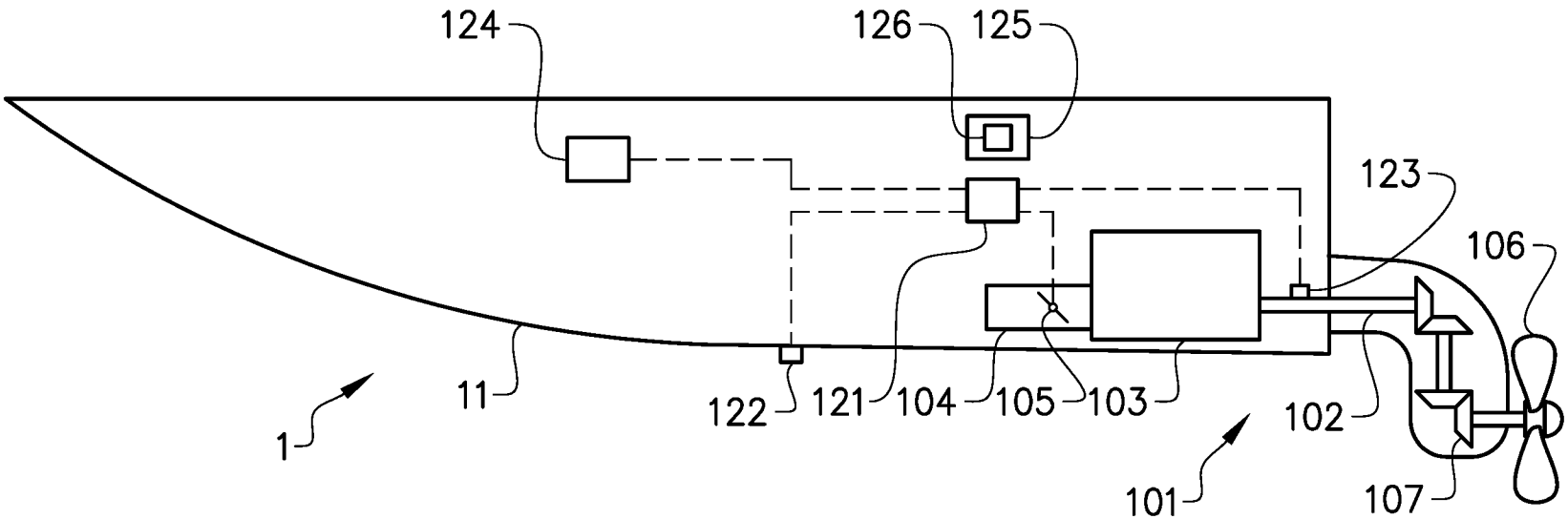
FIG. 1 is a schematic cross-sectional side view of a marine vessel.

FIG. 1 shows a marine vessel 1 in the form of a water surface vessel, more particularly a power boat. The vessel 1 comprises a hull 11. The vessel further comprises a propulsion arrangement 101 for providing propulsive power to the vessel. The propulsion arrangement 101 in this example comprises an internal combustion engine 103, although it should be noted that the invention is equally applicable to vessels with other types of propulsion arrangements, e.g. those including one or more electric motors.

The propulsion arrangement 101 further comprises a propeller 106 and a rotatable part 102 in the form of a driveshaft for of the propulsion arrangement 101. The propeller 106 is mounted on a sterndrive and the driveshaft 102 is connected to the propeller 106 via a set 107 of connecting shafts with beveled gear engagements. The driveshaft 102 is connected to a crankshaft of the engine 103 via a reduction gear (not shown). The propulsion arrangement 101 also comprises an air intake duct 104 for the engine 103. A propulsion arrangement control device 105 in the form of a throttle valve is arranged to control the air flow through the air intake duct 104.

The vessel 1 comprises an electronic control unit 121. The control unit is arranged to access a digital data storage device 125. The control unit 121 is arranged to control the propulsion arrangement control device 105 as exemplified below.

The control unit 121 is further arranged to receive signals from a vessel speed detecting device 122 to determine the speed of the vessel. The vessel speed detecting device 122 may be provided as a paddle wheel sensor mounted so as to protrude from the hull 11 into the water. The vessel speed detecting device 122 may alternatively be of some other suitable type, e.g. it may be a pressure sensor whereby the control unit 121 is arranged to the determine values of the vessel speed based on pressure signals from the sensor. In some embodiments, the vessel speed detecting device 122 may be a device arranged to determine the vessel speed by use of the Global Positioning System (GPS).

The control unit is also arranged to receive signals from a rotational speed detecting device 123 at the rotatable part 102. The rotational speed detecting device may be, for example, provided in the form of a driveshaft position sensor, the signals of which the control unit 121 may use to determine the rotational speed of the driveshaft 102.

The control unit 121 is in addition arranged to receive signals representing requested vessel speed values from a control interface 124 arranged to be manipulated by a driver of the vessel 1. The control unit 121 is further adapted to control the propulsion arrangement control device 105, in this example the throttle valve 105, based at least partly on the signals from the control interface 124.

Figure 2:
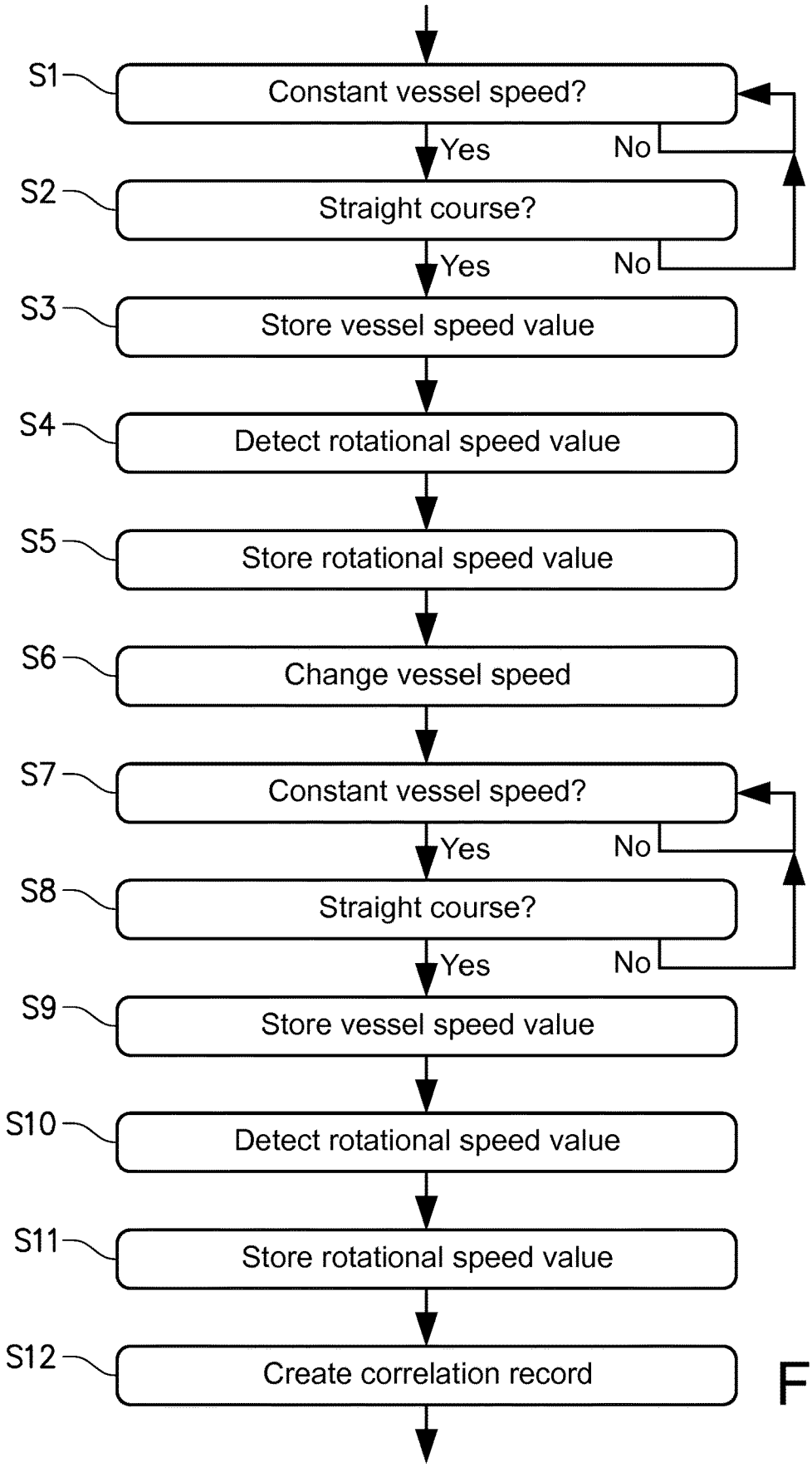
FIG. 2 is a block diagram depicting steps in a method of controlling a propulsion arrangement of the vessel in FIG. 1.

Reference is made to FIG. 2. In a method of controlling the propulsion arrangement 101 the control unit 121 determines S1 whether the vessel 1 is running by means of the propulsion arrangement 101 at a constant vessel speed. This is advantageously done during normal operation of operation of the vessel 1, e.g. for transport, leisure, waterskiing, etc.

The determination S1 whether the vessel 1 is running at a constant vessel speed may be done for example by repeatedly, preferably at regular time intervals, such as 5 seconds, detecting values of the vessel speed by means of the vessel speed detecting device 122.

If the control unit 121 determines that the vessel speed values from at least two consecutive detections are substantially equal, e.g. by being separating by less than a predetermined threshold difference, it is determined that the vessel 1 is running at a constant vessel speed.

The method also comprises determining S2 whether the vessel is moving in a straight course while running at the constant speed. The determination S1 whether the vessel 1 is running at a constant vessel speed is thereby included in a determination S1, S2 whether the vessel is moving straight at constant speed. Determining whether the vessel is moving in a straight course may include determining whether the vessel is turning. In this example this determination is made by a device, included in the control interface 124, arranged to determine the vessel course by use of the Global Positioning System (GPS). In other embodiments such a determination may be made by means of a steering control sensing device, e.g. a position sensor at a steering wheel of the vessel or at the sterndrive for the propeller 106. A steering control sensing device may alternatively be provided as a compass or, where the vessel is provided with a rudder, by a device arranged to detect the angle of the rudder. It should be noted however that in some embodiments, the method may not include such a determination whether the vessel is moving in a straight course.

If it is determined S1 that the vessel is travelling at a constant speed, and if it is determined S2 that the vessel is at the same time moving straight, the value V1 of the constant vessel speed, in this example called the first vessel speed value V1, is stored S3 in the storage device 125.

The method further comprises detecting S4 a value n1 of a rotational speed of the rotatable part 102 of the propulsion arrangement 101 while the vessel is running at the constant vessel speed. In this example the rotatable part 102, the rotational speed of which is detected, is the driveshaft 102. However, in alternative embodiment, the method may include detecting S4 a value n1 of the rotational speed of another rotatable part of the propulsion arrangement 101, such as the engine crankshaft, or a shaft connecting the driveshaft with the propeller 106. The detected rotational speed value n1, in this example called the first rotational speed value n1, is stored S5 in the storage device 125.

Subsequently, e.g. as a result of normal handling of the vessel 1 by the driver, the propulsion arrangement 101 is controlled S6 so as to change the vessel speed, e.g. by control by the control unit 121 of the propulsion arrangement control device 105 based at least partly on signals from the control interface 124 representing a requested vessel speed.

The control unit 121 continues to monitor the vessel speed in order to determine S7 again whether the vessel 1 is running by means of the propulsion arrangement 101 at a constant vessel speed. Thus, after the vessel speed has been changed, the step of, if is determined S7, S8 that the vessel is travelling at a constant speed and at the same time moving straight, storing in the storage device 125 the value of the constant vessel speed is repeated S9. Here this stored value is referred to as the second vessel speed value V2.

In conjunction with storing the second vessel speed value V2, a second rotational speed value n2 is detected S10 when the vessel is travelling at the second vessel speed value V2, and stored S11.

Figure 4:
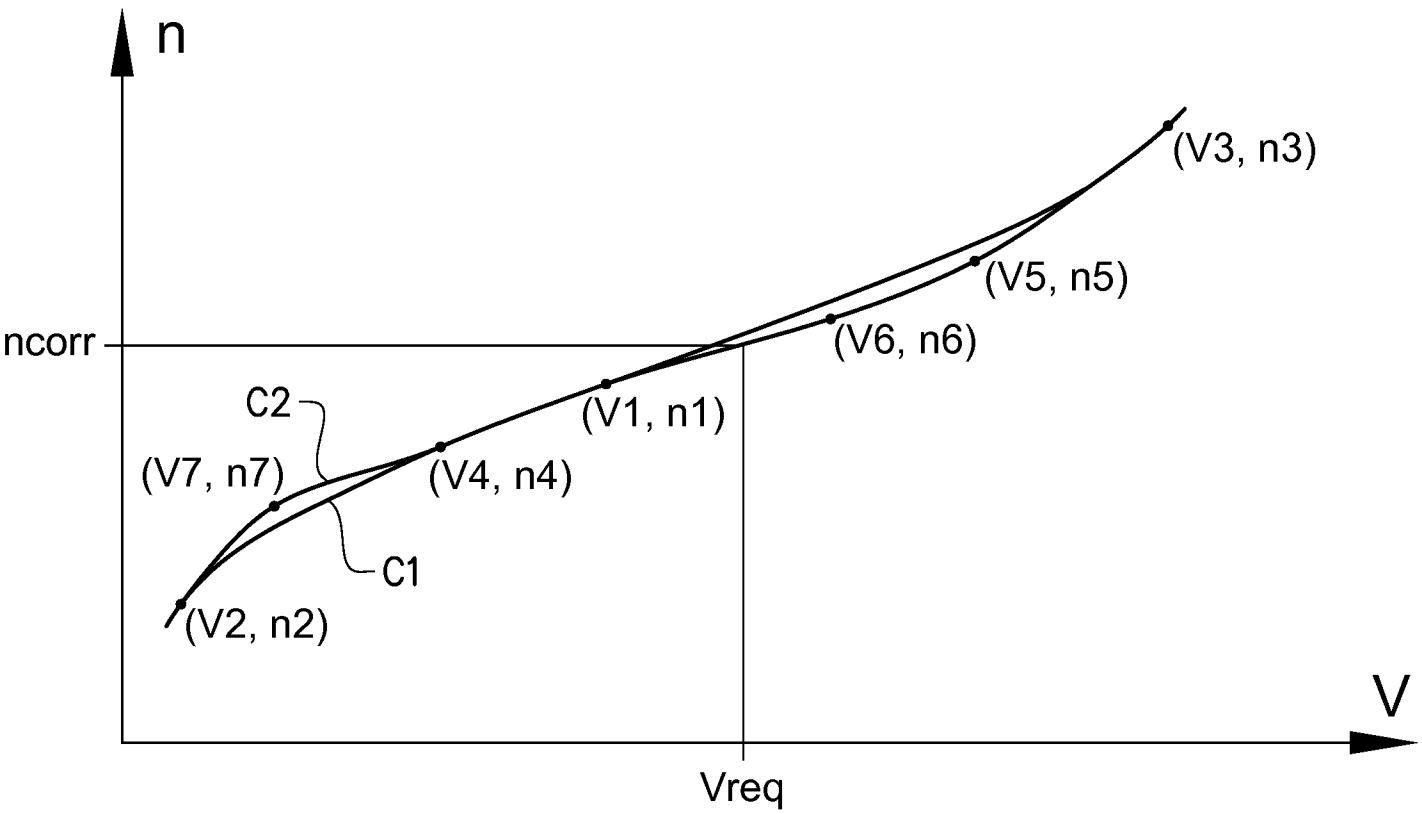
FIG. 4 is a diagram showing correlations of vessel speed values V and values n of the rotational speed of a driveshaft in the vessel in FIG. 1.

Reference is made also to FIG. 4. After further vessel speed changes, whenever the chance is given due to a constant vessel speed and a straight vessel movement, further vessel speed values and rotational speed values are stored, to obtain a plurality of stored pairs of vessel speed values V1-V4 and rotational speed values n1-n4.

The method comprises creating S12 based at least partly on these stored pairs of values V1-V4, n1-n4 a correlation record 126 correlating vessel speed values with rotational speed values. The creation of this correlation record comprises interpolating the stored pairs of values V1-V4, n1-n4. As a result, the correlation record 126 will comprise a continuous function C1 (FIG. 4) relating the vessel speed V to the driveshaft rotational speed n. The correlation record 126 is stored in the storage device 125.

Figure 3:
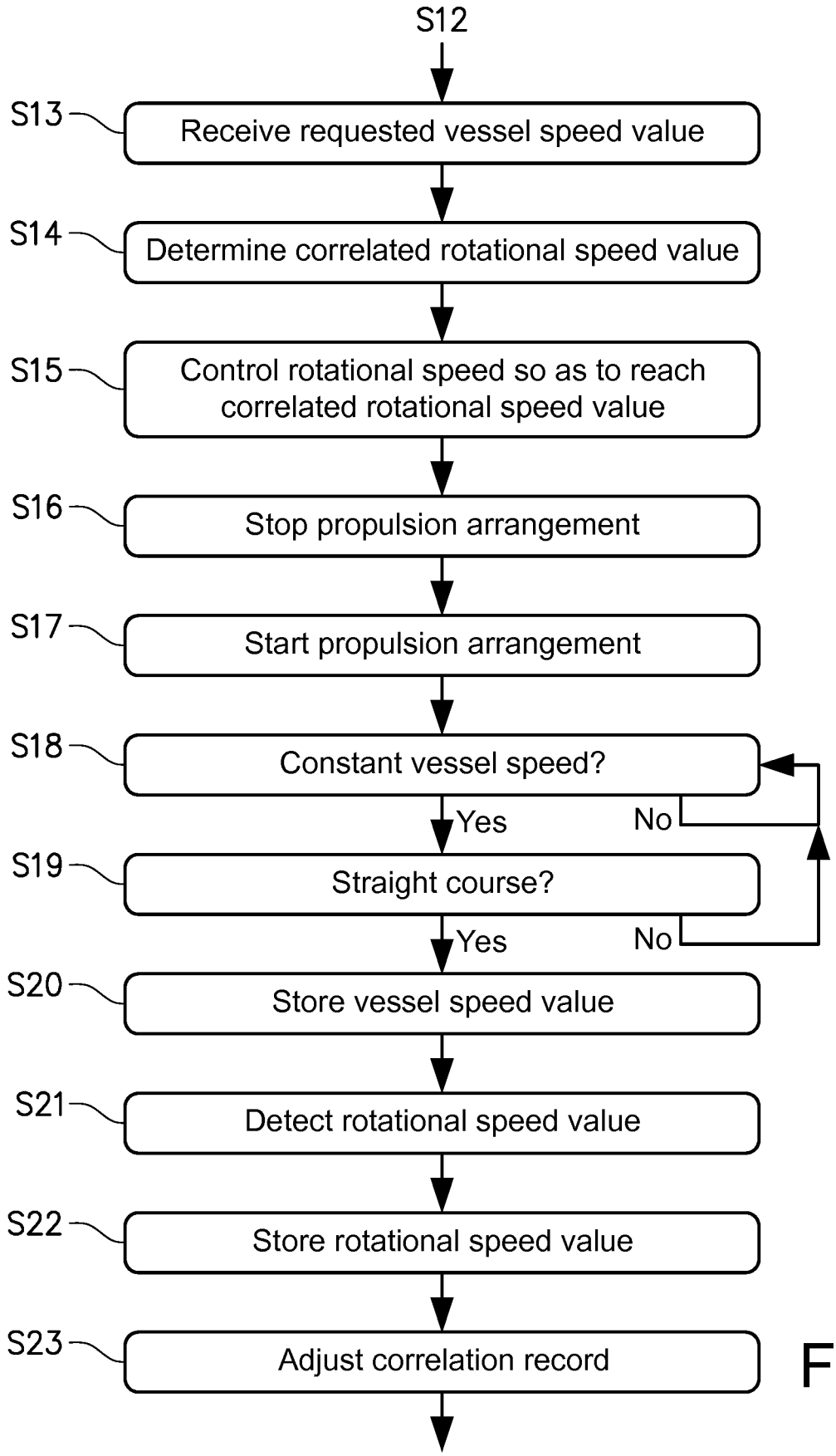
FIG. 3 is a block diagram depicting further steps in the method of controlling a propulsion arrangement of the vessel in FIG. 1.
Figure 5:
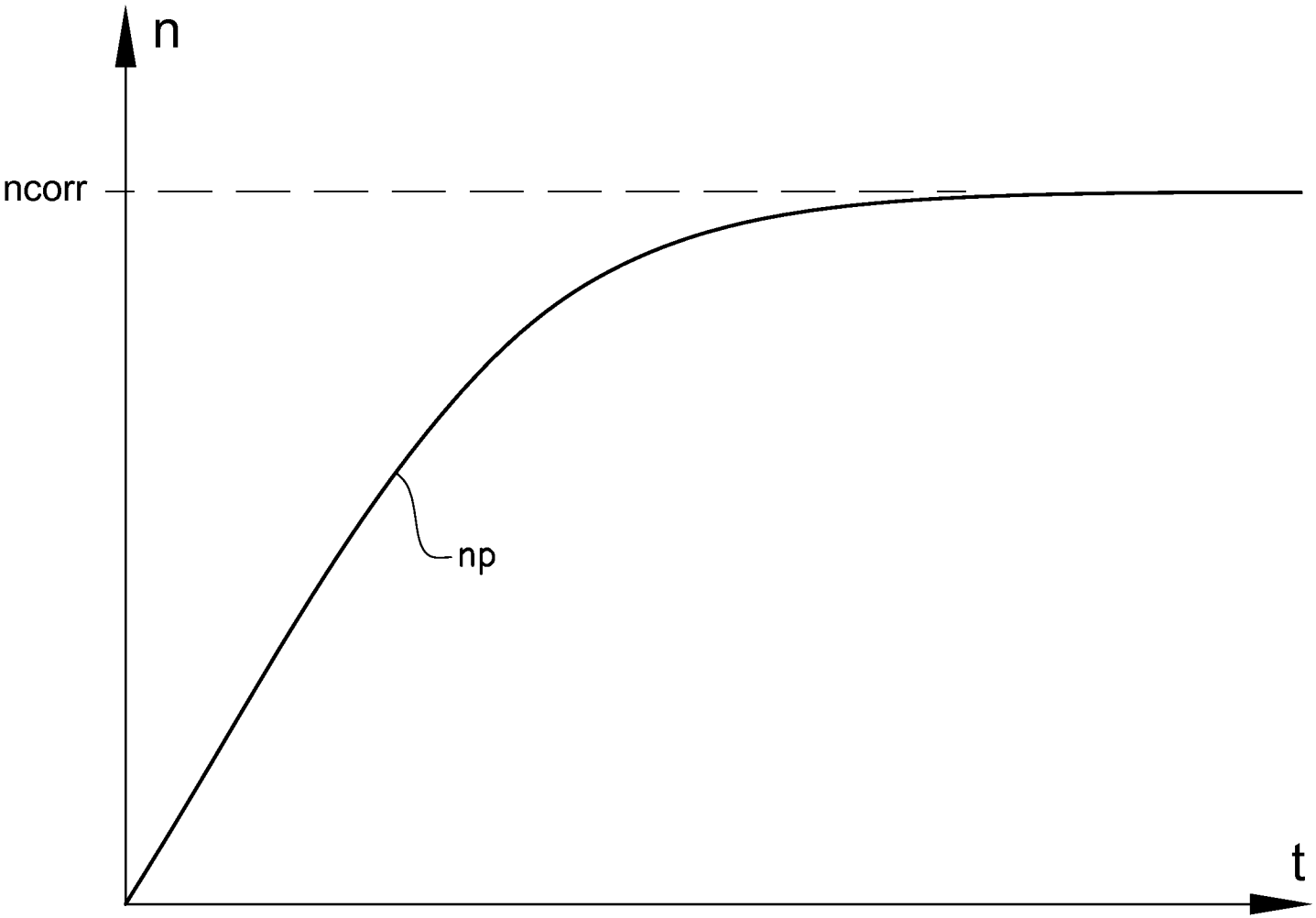
FIG. 5 is a diagram showing the rotational speed of the driveshaft in the vessel in FIG. 1 as a function of time.

With reference to FIG. 3 and FIG. 5 an example will be given on how the correlation record 126 is used. In the method according to this embodiment of the invention, a requested value Vreq of the vessel speed is received S13 from the control interface 124 upon a manipulation thereof by the driver. The method further comprises determining S14 by means of the correlation record 126 a rotational speed value ncorr that is correlated to the requested vessel speed value Vreq.

Thereupon the rotational speed of the driveshaft 102 is controlled S15 so as to reach the correlated rotational speed value ncorr. In the example shown in FIG. 5, the vessel 1 accelerates from a low vessel speed value up to the requested vessel speed value Vreq. Controlling S15 the rotational speed comprises the control unit 121 detecting a present value np of the rotational speed by means of rotational speed detecting device 123. The control unit adjusts the propulsion arrangement control device 105, in this example the throttle valve 105, based at least partly on the detected present rotational speed value np and the correlated rotational speed value ncorr.

As a result, the present rotational speed value np arrived at the correlated rotational speed value ncorr along a continuous and smooth curve. It should be noted that since the control is based on the rotational speed of the propulsion arrangement part 102 rather than the vessel speed, overshooting the requested vessel speed value Vreq may be avoided. The reason is that detected values of said rotational speed are much more likely to be close to the real and current rotational speed values, compared to detected values of the vessel speed in relation to the real and current vessel speed values. This is due to often inherent inaccuracies or delays in the use of vessel speed detecting devices such as paddle wheel sensors or GPS devices. The use of a device for detecting values of the rotational speed of a propulsion arrangement part will considerably reduce or eliminate such inaccuracies or delays.

It should be noted that while in this embodiment the engine is a diesel engine with a throttle valve control, the invention is equally applicable to a vessel with another types of engines, such a gasoline engine. In some embodiments, e.g. in the case of a diesel engine, the control S15 of the rotational speed may comprise adjusting a propulsion arrangement control device 105 in the form of a fuel injection control device of the propulsion arrangement 101.

In this example, after the creation of the correlation record 126, the control unit 121 controls as suggested in FIG. 3 the propulsion arrangement 101 so as to stop S16. This may be the result of normal vessel handling by the driver, and a request to stop the propulsion arrangement received by the control unit 124 from the control interface 124. Subsequently, the control unit 121 controls the propulsion arrangement 101 so as to start S17, again as a result of normal vessel handling by the driver, and a request to start the propulsion arrangement received by the control unit 121 from the control interface 124.

During the subsequent operation the control unit 121 again monitors the vessel speed in order to determine S18 again whether the vessel 1 is running by means of the propulsion arrangement 101 at a constant vessel speed. Thus, if it is determined S18 that the vessel is travelling at a constant speed, and if it is determined S19 that the vessel is at the same time moving straight, storing in the storage device 125 the value V5 of the constant vessel speed is further repeated S20. Also, in conjunction with this vessel speed value storage, a further rotational speed value n5 is detected S10 when the vessel is travelling at said vessel speed value V5, and stored S11. Again, whenever the chance is given due to a constant vessel speed and a straight vessel movement, further vessel speed values and rotational speed values are detected and stored, to obtain a plurality of stored further pairs of vessel speed values V5-V7 and rotational speed values n5-n7.

As illustrated in FIG. 4, the further pairs of vessel speed values V5-V7 and rotational speed values n5-n7 are used to adjust S23 the correlation record 126. The adjustment of this correlation record comprises interpolating the stored pairs of values V1-V7, n1-n7, including the added further pairs of values V5-V7, n5-n7. As a result, the correlation record 126 will comprise a continuous function C2 (FIG. 4) relating the vessel speed V to the driveshaft rotational speed n, which function is different and more accurate than the function C1 obtained without the further pairs of values V5-V7, n5-n7.

Adjusting S23 the correlation register may include excluding or deleting from the correlation register 126 one or more pairs of vessel speed and rotational speed values, the storage of which is above a predetermined age. The age may be determined in alternative manners. In some embodiments, adjusting S23 the correlation register may include excluding from the correlation register 126 pairs of vessel speed and rotational speed values which were stored at respective points in time differing from the present point in time by more than a predetermined time threshold value. Thereby, old value entries may be removed since they might have become inaccurate, e.g. due to normal changes in the vessel behaviour due its operational history, or due to external fouling of the hull 11. It should be noted that the time threshold value may refer to absolute time, or only the time during which the vessel and/or the propulsion arrangement is in operation.

The predetermined age of a pair of vessel speed and rotational speed values may in some embodiments be related to the number of driving cycles of the vessel. A vessel driving cycle may be defined as an operation of the vessel from a start event of the propulsion arrangement to a stopping event thereof, with an uninterrupted propulsion arrangement operation between said events. In some embodiments, adjusting S23 the correlation register may include excluding or deleting from the correlation register 126 pairs of vessel speed and rotational speed values which were stored during a vessel driving cycle that occurred a predetermined number of driving cycles before the present or most recent driving cycle. For example, adjusting S23 the correlation register may include excluding from the correlation register 126 pairs of vessel speed and rotational speed values which were stored during a vessel driving cycle that occurred before the driving cycle that preceded the present or most recent driving cycle.

It should be noted that the invention is applicable also in vessels 1 where the propulsion arrangement comprises two or more powertrains, each including a propeller and an engine or an electric motor. In such embodiments, the rotational speed of a rotational part of one of the powertrains may be detected for the correlation record 126 as described above, and the rotational speed of the same part may be used for a speed control similar to the one described above with reference to FIG. 5.

Vessels with more than one powertrain may be used with less than all powertrains in operation. Embodiments of the invention may include determining how many of the powertrains that are in operation. The correlation record 126 may be arranged to correlate each vessel speed value to different rotational speed values depending on the number of powertrains in operation. Such a selective correlation may be made during the detection and storage of the vessel speed value and the rotational speed value. Such a selective correlation may also be made in the steps of receiving S13 a requested value Vreq of the vessel speed, and determining S14 a rotational speed value ncorr that is correlated to the requested vessel speed value Vreq. I.e. the correlation record may provide a different correlated rotational speed value ncorr depending on the number of powertrains in operation when the requested vessel speed value Vreq is received.

It is to be understood that the present invention is not limited to the embodiments described above and illustrated in the drawings; rather, the skilled person will recognize that many changes and modifications may be made within the scope of the appended claims.

The invention claimed is:

1. A method for a propulsion arrangement for providing propulsive power to a marine vessel, characterized by determining (S1) whether the vessel is running by means of the propulsion arrangement at a constant vessel speed, storing (S3) a detected value (V1) of the constant vessel speed, detecting (S4) a value (n1) of a rotational speed of a rotatable part of the propulsion arrangement while the vessel is running at the constant vessel speed, storing (S5) the detected rotational speed value (n1), subsequently controlling (S6) the propulsion arrangement so as to change the vessel speed, subsequently repeating (S7-S11) the steps of determining whether the vessel is running at a constant vessel speed, storing a detected value (V2-V4) of the constant vessel speed, and detecting and storing a value (n2-n4) of the rotational speed of the rotatable part, to obtain a plurality of stored pairs of vessel speed values (V1-V4) and rotational speed values (n1-n4), and creating (S12) based at least partly on the stored pairs of values (V1-V4, n1-n4) a correlation record correlating vessel speed values with rotational speed values.

2. A method according to claim 1, characterized in that the step of creating a correlation record comprises interpolating the stored pairs of values (V1-V4, n1-n4).

3. A method according to claim 1, characterized by stopping (S16) the propulsion arrangement after creating the correlation record, subsequently starting (S17) the propulsion arrangement, subsequently (S20-S22) repeating the steps of determining whether the vessel is running at a constant vessel speed, storing a detected value (V5-V7) of the constant vessel speed, and detecting and storing value (n5-n7) of the rotational speed of the rotatable part, and adjusting (S23) the correlation record based at least partly on the vessel speed and rotational speed values (V5-V7, n5-n7) detected after the step of starting the propulsion arrangement.

4. A method according to claim 3, characterized in that adjusting (S23) the correlation register comprises deleting from the correlation register at least one pair of a vessel speed value and a rotational speed value, the storage of which is above a predetermined age.

5. A method according to claim 1, characterized by determining (S2) whether the vessel is moving in a straight course while running at the constant speed, such that the plurality of stored pairs of vessel speed values (V1-V4) and rotational speed values (n1-n4), based on which the correlation record is created, are detected while the vessel is moving in a straight course.

6. A method according to claim 1, characterized by receiving (S13) a requested value (Vreq) of the vessel speed, determining (S14) by means of the correlation record a rotational speed value (ncorr) that is correlated to the requested vessel speed value (Vreq), and controlling (S15) the rotational speed so as to reach the correlated rotational speed value (ncorr).

7. A method according to claim 6, characterized in that controlling (S15) the rotational speed comprises detecting a present value (np) of the rotational speed, and adjusting a propulsion arrangement control device based at least partly on the detected present rotational speed value (np) and the correlated rotational speed value (ncorr).

8. A method according to claim 6, characterized in that the requested vessel speed value (Vreq) is received (S13) from a control interface arranged to be manipulated by a driver of the vessel.

9. A method according to claim 1, where the propulsion arrangement comprises more than one powertrain, characterized by determining how many of the powertrains that are in operation, wherein the correlation record's correlation of the vessel speed values with rotational speed values depends on the number of powertrains in operation.

10. A computer program comprising program code means for performing the steps of claim 1 when said program is run on a computer.

11. A computer readable medium carrying a computer program comprising program code means for performing the steps of claim 1 when said program product is run on a computer.

12. A control unit configured to perform the steps of the method according to claim 1.

13. A propulsion arrangement comprising a control unit according to claim 12.

14. A marine vessel comprising a propulsion arrangement according to claim 13.

* * * * *